US006161615A

United States Patent [19]

Brieden et al.

[11] Patent Number: 6,161,615

[45] Date of Patent: Dec. 19, 2000

[54] PLATE-TYPE HEAT EXCHANGER, ESPECIALLY OIL/COOLANT COOLER IN VEHICLES

[75] Inventors: Thomas Brieden, Waiblingen; Markus Layer, Korb, both of Germany

[73] Assignee: Knecht Filterwerke GmbH, Stuttgart, Germany

[21] Appl. No.: 09/355,823

[22] PCT Filed: May 12, 1998

[86] PCT No.: PCT/DE98/01317

§ 371 Date: Aug. 5, 1999

§ 102(e) Date: Aug. 5, 1999

[87] PCT Pub. No.: WO98/54527

PCT Pub. Date: Dec. 3, 1998

[30] Foreign Application Priority Data

May 27, 1997 [DE] Germany ..... 197 22 074

[51] Int. Cl.[7] ..... F28D 9/00

[52] U.S. Cl. ..... 165/166; 165/47; 165/167; 165/916

[58] Field of Search ..... 165/41, 47, 166, 165/167, 916

[56] References Cited

U.S. PATENT DOCUMENTS

| | | | |
|---|---|---|---|
| 5,165,468 | 11/1992 | Tajima et al. | 165/47 |
| 5,511,612 | 4/1996 | Tajima et al. | 165/167 |

FOREIGN PATENT DOCUMENTS

| | | | |
|---|---|---|---|
| 0 273 462 | 7/1988 | European Pat. Off. . | |
| 38 24 073 | 2/1990 | Germany . | |
| 41 25 079 | 2/1992 | Germany . | |
| 43 14 808 | 11/1994 | Germany . | |
| 62-202997 | 9/1987 | Japan | 165/916 |
| WO91/13308 | 9/1991 | WIPO . | |
| WO97/23759 | 7/1997 | WIPO . | |

*Primary Examiner*—Allen Flanigan
*Attorney, Agent, or Firm*—Collard & Roe, P.C.

[57] ABSTRACT

Disclosed is a heat exchanger comprising superimposed heat exchanger plates (, 2'), a collar (4), fluid connectors (12), connecting holes (5) and fastening means which present at least one passage (15) comprised of holes (6, 27) in alignment towards each other in the plates (2, 2'), through which a tension rod (16) can be passed. One end of the tension rod (16) rests upon the connecting plate (26) or the plate (2, 2') adjacent thereto. In the hole (6, 27) alignment area, each thermal plate is tight relative to the adjacent plate (2, 2').

6 Claims, 2 Drawing Sheets

PLATE-TYPE HEAT EXCHANGER, ESPECIALLY OIL/COOLANT COOLER IN VEHICLES

Figure 1:
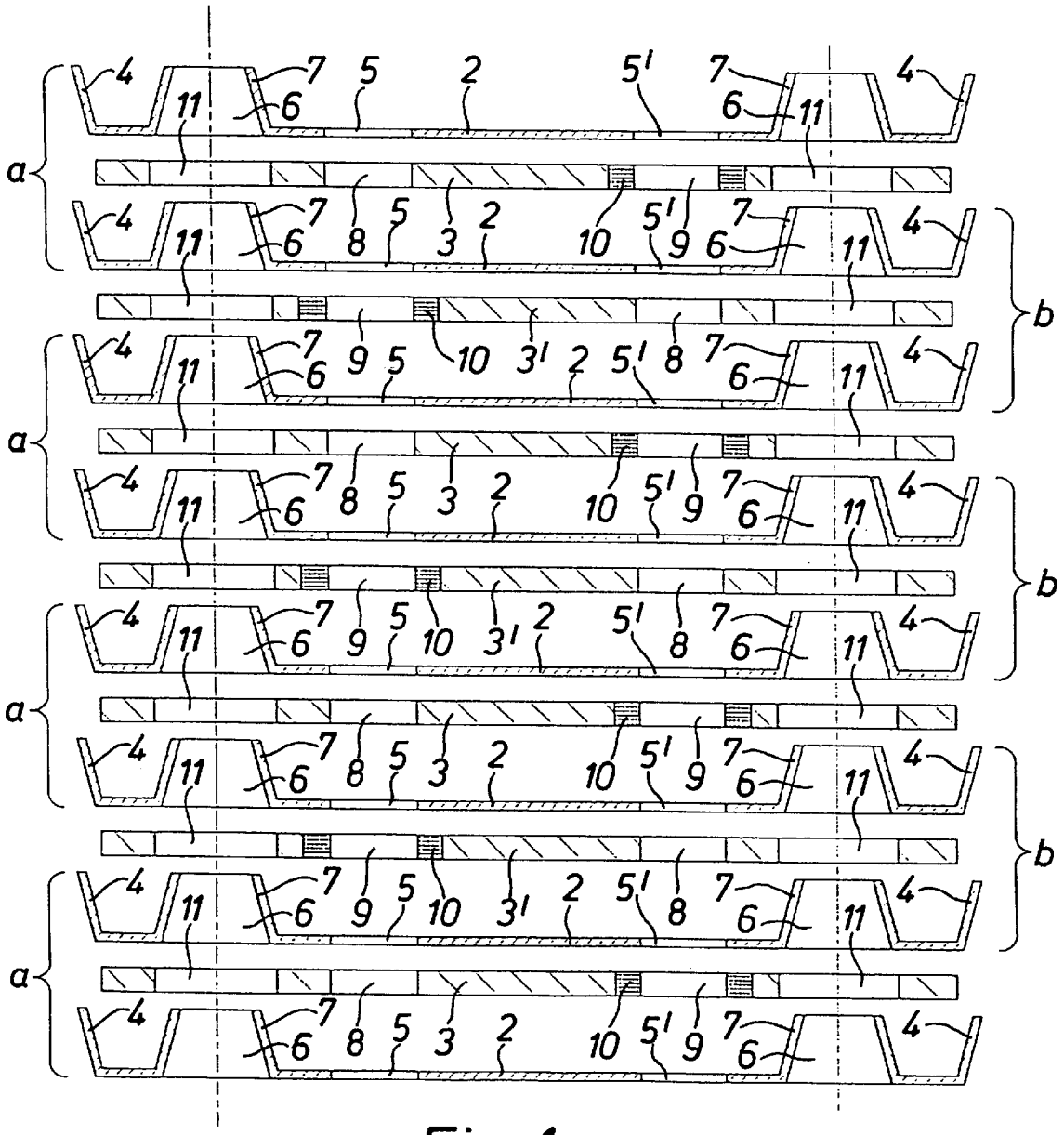

The invention relates to a plate heat exchanger, in particular an oil/coolant cooler for internal combustion engines, having the features of the preamble of claim 11.

A plate heat exchanger of the abovementioned type, known from DE 43 14 808, has, for closing off the plate heat exchanger sealingly, a closing plate on its heat exchanger plate which, in the mounted state, is adjacent to the connected body. This closing plate may additionally serve as a fastening element, for which purpose it is provided with bores which cooperate with bolts or screws as fastening means, in order to fasten the plate heat exchanger, for example, to an engine block. Alternatively, a fastening plate is proposed, which is designed according to individual requirements and, for example, is prepared for fastening to a special engine block. This fastening plate may be mounted on the plate heat exchanger in addition to the closing plate or be fastened, instead of the closing plate, to the heat exchanger plate adjacent to the connected body (for example, engine block), the fastening plate then also serving at the same time as closing plate.

EP 0 273 462 discloses a plate heat exchanger of the type described above, in which the peripheral collar of one heat exchanger plate rests against the peripheral collar of the adjacent heat exchanger plate or against the edge of the connecting plate and is sealingly connected, in particular soldered, thereto by assembly.

The fastening elements of this known plate heat exchanger comprise at least one passage which is formed from mutually aligned orifices in the heat exchanger plates and in the connecting plate. A fastening means designed as a tension rod can be led through the passage, in which case, in order to fasten the plate heat exchanger, the tension rod, at one end, rests externally, in the region of the passage, on the connecting plate and/or on the heat exchanger plate adjacent to the latter and, at the other end, is anchored in the body.

Each heat exchanger plate is sealed off, in the region of the aligned orifices, relative to the adjacent heat exchanger plate or relative to the adjacent connecting plate.

The aligned orifices of the heat exchanger plates are each provided with a peripheral collar, the peripheral collar of one orifice of a heat exchanger plate bearing against the peripheral collar of the adjacent orifice of the adjacent heat exchanger plate or against the edge of the adjacent orifice in the connecting plate and being sealingly connected, in particular soldered, thereto by assembly.

The invention is concerned with the problem that the known closing plate or fastening plate may experience deformation under the high pressures occurring in a plate heat exchanger of this kind, the oil cooler being lifted off from the connected body in the region of connection of the latter. This may result, on the one hand, in increased wear of the plate heat exchanger and, on the other hand, in reduced sealing off relative to the connected body.

This problem is solved by means of the plate heat exchanger according to the invention having the features of patent claim 11.

An embodiment having the features as claimed in claim 12 makes it possible to have a particularly simple connection, in particular a soldered connection, of the individual heat exchanger plates with one another, both on the peripheral collar of the heat exchanger plate and on the peripheral collar of the aligned orifices.

Other features and advantages essential to the invention may be gathered from the subclaims and from the following description of a preferred exemplary embodiment.

Figure 2:
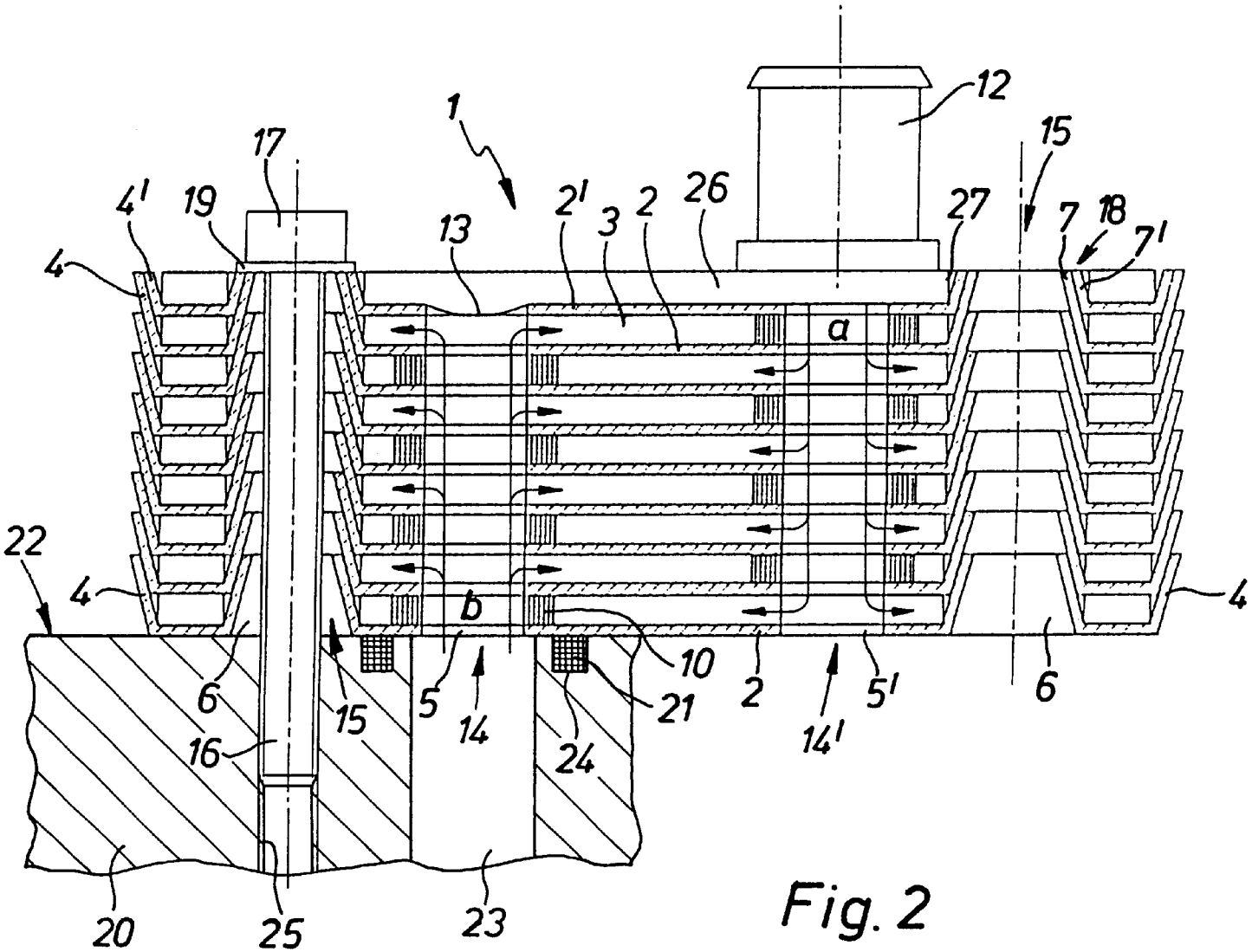

In the diagrammatic drawing:

FIG. 1 shows an exploded drawing of heat exchanger plates and turbulence inserts of a plate heat exchanger according to the invention, and FIG. 2 shows a cross section through a plate heat exchanger according to the invention.

FIG. 1 shows, in an exploded illustration, a sectional view of eight heat exchanger plates 2 with turbulence inserts 3 and 3' located between them. Each heat exchanger plate 2 has a peripheral collar 4 which is angled upward at an angle of about 75° relative to the plane of the heat exchanger plate 2, according to FIG. 1. Each heat exchanger plate 2 has four passage orifices 5 and 5', only two of which can be seen, however, in this sectional illustration. Contrary to the exemplary embodiment illustrated, the passage orifices 5 and 5' do not have to be of the same cross section. In the vicinity of the peripheral collar 4, four orifices 6 are provided in each heat exchanger plate 2, each of which orifices is provided with a peripheral collar 7. Only two of the orifices 6 can be seen in each heat exchanger plate 2 in the section illustrated here.

A turbulence insert 3 and 3' is arranged in each case between two heat exchanger plates 2. Each turbulence insert has orifices 8 and 9 corresponding to the passage orifices 5 and 5' of the heat exchanger plates 2. Introduced into each of the orifices 9 is a sealing ring 10, the outside diameter of which corresponds approximately to the inside diameter of the orifice 9 and the inside diameter of which corresponds approximately to the inside diameter of the orifices 5 and 5'. The inside diameter of the orifice 8 of the turbulence insert 3 and 3' corresponds approximately to the inside diameter of the orifice 5 and 5' in the heat exchanger plate 2. Two orifices 8 and two orifices 9, with a sealing ring 10 introduced therein, are provided in each turbulence insert 3 and 3', in which case only one orifice 8 and one orifice 9 as well as one sealing ring 10 are visible in the sectional illustration. Correspondingly, each turbulence insert 3 and 3' contains four orifices 11 which are assigned to the orifice 6 of the heat exchanger plates 2 and the inside diameter of which corresponds approximately to the outside diameter at the commencement of the collar 7 on the orifice 6.

According to FIG. 1, the orifices 5 are provided on the left-hand side of the heat exchanger plates and the orifices 5' on the right-hand side of these. The turbulence inserts 3 have the sealing rings 10 on their right-hand side and the turbulence inserts 3' have them on their left-hand side.

The turbulence inserts 3 and 3' are inserted between the heat exchanger plates 2 in such a way that the orifices 11 frame the collars 7 and the orifices 8 and 9 come to lie approximately congruently over the orifices 5 and 5' of the heat exchanger plates 2. At the same time, the turbulence inserts 3 and 3' are arranged in such a way that the sealing rings 10 are assigned alternately to the orifices 5 and 5'.

The sealing rings 10 have approximately the same thickness as the turbulence inserts 3 and 3'. The sealing rings 10 may be produced from a metallic material or from a plastic or from ceramic.

When the heat exchanger plates 2 are stacked one on the other, the sealing rings 10 seal off the orifices 5 and 5' relative to a space formed between adjacent heat exchanger plates 2 and relative to the turbulence insert 3 or 3' inserted into said space. This gives rise to ducts, through which a respective fluid can pass to the next interspace. The interspaces are thereby filled alternately with the cooling fluid and with the fluid to be cooled, for example oil. For example, the orifices 5 and the interspaces communicating with them may be assigned the coolant, the associated turbulence inserts 3 and the heat exchanger plates 2 adjacent to them being identified by a brace, designated by a, on the left-hand side of FIG. 1. On the other side, the fluid to be cooled is assigned to the orifices 5' and to the interspaces communicating with them and having the turbulence inserts 3', this being identified by the braces, designated by b, on the right-hand side in FIG. 1.

According to FIG. 2, a plate heat exchanger 1 with heat exchanger plates 2 stacked one on the other and assembled so as to be sealed off has, in addition, a connecting plate 26 which is inserted into the heat exchanger plate 2' uppermost according to FIG. 2 and which has, in a way corresponding to the turbulence inserts 3 and 3', orifices 27 which are assigned to the orifices 6 of the heat exchanger plate 2. This uppermost heat exchanger plate 2' differs from the other heat exchanger plate 2 in the height of its peripheral collar 4' and in the height of the collars 7' on the orifices 6. In this case, the collars 4' and 7' of the uppermost heat exchanger plate 2' are about half the size of the corresponding collars 4 and 7 of another heat exchanger plate 2, so that the collars 4' and 7' of the uppermost heat exchanger plate 2' and the collars 4 and 7 of the heat exchanger plate 2 adjacent to it terminate together on their free end faces. The individual heat exchanger plates 2 and 2' are sealingly connected to one another, for example by soldering, at their overlapping collars 4, 4', 7, 7'. The connecting plate 26 is likewise fastened to the uppermost heat exchanger plate 2' so as to be sealed off relative to the latter.

The connecting plate 26 has two connection pieces 12 which are assigned to the passage orifices 5' for the supply and discharge of the first fluid, for example a coolant. In the sectional view illustrated in FIG. 2, however, only one of the connection pieces 12 can be seen. In order to close the passage orifices 5 assigned to the second fluid, in particular the oil to be cooled, the connecting plate 26 has convexities 13 which project in each case into a corresponding passage orifice 5 of the uppermost heat exchanger plate 2. Improved sealing off between the uppermost heat exchanger plate 2' and the connecting plate 26 is thereby achieved, and, moreover, the convexities 13 assist in positioning the connecting plate 26 while the plate heat exchanger 1 is being assembled.

The passage orifices 5 located in alignment one above the other form a passage duct 14, for example for the medium to be cooled, whilst the passage orifices 5' located in alignment one above the other form a passage duct 14', for example for the cooling medium. In addition to the passage ducts 14 and 14', a further similarly formed passage duct 14' for the first fluid and a further passage duct 14 for the second fluid are also provided in the plate heat exchanger 1, but neither of these can be seen in this sectional illustration. In this way, there are formed in the plate heat exchanger 1, on the one hand, a first fluid circuit, here for the cooling medium, consisting of the passage orifices 5' and the passage ducts 14' and of the interspaces communicating with them between the heat exchanger plates 2, and, on the other hand, a second fluid circuit, here for the medium to be cooled, which consists of the passage ducts 14 and the passage orifices 5 and the interspaces communicating with them between the heat exchanger plates 2 and 2'. In order to illustrate a possible flow through the plate heat exchanger 1, the passage duct 14' shown on the right serves for the inflow of the coolant, which is distributed in the associated interspaces according to the arrows a, and the passage duct 14 shown on the left serves for the inflow of the oil to be cooled, which in turn flows into the associated interspaces according to the arrows b. The outflow then takes place in each case through the passage ducts 14 and 14' which are not shown.

In order to connect the plate heat exchanger 1 to another body 20, partially illustrated, for example to an engine block of a motor vehicle, this body 20 is provided with a connecting surface 22 corresponding to the plane underside of the heat exchanger plate 2 lowermost according to FIG. 2. In this case, the passage ducts 14 overlap corresponding supply and discharge lines 23 for the second fluid (oil to be cooled), the passage orifices 5 of the lowermost heat exchanger plate 2 forming the corresponding connecting orifices for the supply and discharge of the second fluid. The passage ducts 14 of the first fluid circuit are, in this case, sealed off relative to the connected body 20 at the passage orifices 5' in the lowermost heat exchanger plate 2 by corresponding sealing means; in particular, convexities in the manner of the convexities 13 on the connecting plate 26 may be provided on the connecting surface 22 of the body, in order to make it easier to position the plate heat exchanger 1 on the body 20.

In order to fasten the plate heat exchanger 1 to the connected body, passages 15 are provided which run in the latter perpendicularly to the planes of the heat exchanger plates 2. In this case, each passage 15 is formed from the mutually overlapping interconnected collars 7 and 7' of the orifices 6 in the heat exchanger plates 2 and 2'. By being interconnected, for example by soldering, the collars 7 and 7' adjacent to one another form a kind of sleeve which can be subjected to pressure load in its axial direction. The interior of this sleeve in this case forms the passage 15.

In order to fix the plate heat exchanger 1 to the connected body 20, a tension rod, for example a screw 16, is led through the passage 15, and, on the one hand, rests with its head 17 on the end face of the sleeve formed from the collar 7 and 7' and, on the other hand, is anchored in the body 20. In the exemplary embodiment shown, the end faces of the collar 7' and 7 of the uppermost heat exchanger plate 2' and of the heat exchanger plate 2 adjacent to the latter terminate together and, at the same time, form a support 18 which serves as an abutment on which the screw head 17 rests via a washer 19 and which introduces a tensile force of said screw head into the plate heat exchanger 1.

In the same way as the screw 16 illustrated in the exemplary embodiment, a lynchpin or a threaded rod emanating from the body 20 may serve as a tension rod, the plate heat exchanger 1 being fixed to the body 20 correspondingly by means of screw nuts.

According to FIG. 2, the plate heat exchanger 1 is fastened to the body 20, for example to the left-hand side. Provided in the plane connecting surface 22 of the body 20 is an inflow line 23 which communicates with the inflow of the second fluid circuit of the plate heat exchanger 1, to which fluid circuit the passage ducts 14, the orifices 5 and the associated interspaces are assigned. An annular groove 24 is cut out coaxially to the supply line 23 in the connecting surface 22 of the body 20, a sealing ring 21 being inserted into said annular groove in order to seal off the body 20 relative to the second fluid circuit of the plate heat exchanger 1. In a similar way, further sealing rings may be provided in the connecting surface 22 of the body 20, in order to seal off the open ends of the passage ducts 14' of the first fluid circuit relative to the body 20.

The screw 16 introduced through the passage 15 and passing through the plate heat exchanger 1 is screwed into a threaded bore 25 in the body 20. Preferably, in order to anchor the plate heat exchanger 1 to the body 20, four tension rods 16, arranged in each case in the region of a corner of the plate heat exchanger 1, are used, in order to achieve as uniform a distribution of the fastening forces as possible. Even when high pressures occur, the plate heat exchanger 1 cannot lift off from the connected body 20, since the tension rods 16 counteract the expansion in volume of the plate heat exchanger 1, occurring due to their high tensile strength, from the top side of the plate heat exchanger 1 facing away from the body 20. An expansion in volume of the plate heat exchanger 1 therefore results in an increased pressure force of the plate heat exchanger 1 against the body 20 and consequently also an increase in the sealing effect at the axial seals 21.

Instead of arranging the passages 15, as in the exemplary embodiment, within the normally rectangular contour of the heat exchanger plates 2 and 2', special bulges or lugs may also be provided on the outside of the heat exchanger plates 2 and 2', the orifices 6 being located with their collars 7 and 7' in said bulges or lugs in order to form passages 15. In this way, the tension rods 16 also pass through the heat exchanger plates 2 and 2', but without at the same time influencing the internal structure of the plate heat exchanger 1 and the throughflow circuits.

What is claimed is:

1. A plate heat exchanger, with a plurality of trough-shaped heat exchanger plates (2,2') which are stacked one on the other and which have a peripheral collar (4,4'), with a connecting plate (26) which has connection pieces (12) for the supply and discharge of a first fluid, with connecting orifices for the supply and discharge of a second fluid, with fastening elements (15) which cooperate with fastening means (16) in order to fasten the plate heat exchanger (1) to another body (20), and having the following features:

the peripheral collar (4, 4') of one heat exchanger plate (2, 2') bears against the peripheral collar (4, 4') of the adjacent heat exchanger plate (2, 2') or against the edge of the connecting plate (26) and is sealingly connected, thereto by assembly, the fastening elements comprise at least one passage (15) which is formed from mutually aligned orifices (6,27) in the heat exchanger plates (2, 2') and in the connecting plate (26), a fastening means designed as a tension rod (16) can be led through the passage (15), in which case, in order to fasten the plate heat exchanger (1), the tension rod (16), at one end, rests externally, in the region of the passage (15), on the connecting plate (26) and/or on the heat exchanger plate (2') adjacent to the latter and, at the other end, is anchored in the body (20), each heat exchanger plate (2, 2') is sealed off, in the region of the aligned orifices (6, 27), relative to the adjacent heat exchanger plates (2, 2') or relative to the adjacent connecting plate (26), the aligned orifices (6) of the heat exchanger plates (2, 2') are in each case provided with a peripheral collar (7, 7'), the peripheral collar (7, 7') of one orifice (6) of a heat exchanger plate (2, 2') bears against the peripheral collar (7, 7') of the adjacent orifice (6) of the adjacent heat exchanger plate (2, 2') or against the edge of the adjacent orifice (26) in the connecting plate (26) and is sealingly connected, in particular soldered, thereto by assembly, defined by the following features:

the collars (7, 7') of the orifices (6) are arranged on the heat exchanger plates (2, 2') in such a way that said collars are directed away from the body (20) when the plate heat exchanger (1) is fastened to the body (20), and the free end face of the collar (7') of the respective orifice (6) of a heat exchanger plate (2') adjacent to the connecting plate (26) forms an abutment (18) for the tension rod (16).

2. The plate heat exchanger as claimed in claim 1, wherein the collars (7, 7') of each orifice (6) and the peripheral collar (4, 4') of the heat exchanger plate (2, 2') have, in amount, the same angle of inclination relative to the plane of the heat exchanger plate (2, 2').

3. The plate heat exchanger as claimed in claim 1, wherein the free end face of the collar (7') of the respective orifice (6) of a heat exchanger plate (2') adjacent to the connecting plate (26) terminates together with the free end face of the collar (7) of the orifices (6) of the adjacent heat exchanger plate (2), these free end faces adjacent to one another together forming an abutment (18) for the tension rod (16).

4. The plate heat exchanger as claimed in claim 1, wherein the collar (7, 7') of each orifice (6) and the peripheral collar (4, 4') of the heat exchanger plate (2, 2') project from the same side of the heat exchanger plate (2, 2').

5. The plate heat exchanger as claimed in claim 1, wherein the tension rod led through a passage (15) in order to fasten the plate heat exchanger (1) to the corresponding body (20) is designed as a screw (16).

6. The plate heat exchanger as claimed in claim 1, wherein the heat exchanger plate (2) which is adjacent when the plate heat exchanger (1) is fastened to the body (20) is designed in the plane on its outside at least in the region of the connecting orifices (5) for the supply and discharge of the second fluid.

* * * * *